US009163865B2

(12) United States Patent
Wakamoto et al.

(10) Patent No.: US 9,163,865 B2
(45) Date of Patent: Oct. 20, 2015

(54) REFRIGERATION CYCLE DEVICE AND METHOD OF CONTROLLING THE SAME

(75) Inventors: Shinichi Wakamoto, Chiyoda-ku (JP); Fumitake Unezaki, Chiyoda-ku (JP); Takeshi Kuramochi, Chiyoda-ku (JP); Hitoshi Iijima, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 680 days.

(21) Appl. No.: 12/995,343

(22) PCT Filed: Nov. 11, 2008

(86) PCT No.: PCT/JP2008/070445

§ 371 (c)(1),
(2), (4) Date: Nov. 30, 2010

(87) PCT Pub. No.: WO2009/150761

PCT Pub. Date: Dec. 17, 2009

(65) Prior Publication Data

US 2011/0083456 A1 Apr. 14, 2011

(30) Foreign Application Priority Data

Jun. 13, 2008 (JP) ..... 2008-155520

(51) Int. Cl.
*G05D 15/00* (2006.01)
*F25B 41/04* (2006.01)
(Continued)

(52) U.S. Cl.
CPC ..... *F25B 41/00* (2013.01); *F24F 2011/0084* (2013.01); *F25B 40/02* (2013.01);
(Continued)

(58) Field of Classification Search
CPC ..... F25B 41/00
USPC ..... 62/225, 513, 204, 222; 165/279–284
See application file for complete search history.

(56) References Cited

U.S. PATENT DOCUMENTS 3,039,941 A * 6/1962 Sweeney et al. ..... 203/2
5,392,612 A * 2/1995 Alsenz ..... 62/115
(Continued)

FOREIGN PATENT DOCUMENTS

JP 6 265232 9/1994
JP 6 331223 11/1994
(Continued)

OTHER PUBLICATIONS

International Search Report issued Dec. 16, 2008 in PCT/JP08/070445 filed Nov. 11, 2008.
(Continued)

*Primary Examiner* — Frantz Jules
*Assistant Examiner* — Steve Tanenbaum
(74) *Attorney, Agent, or Firm* — Oblon, McClelland, Maier & Neustadt, L.L.P.

(57) ABSTRACT

A refrigeration cycle device 100 where a combustible refrigerant circulates includes a bypass pipe 5 that is connected so that part of the refrigerant that flows through a circulation pipe extending from a condenser 2 to a flow control valve 3 bypasses the flow control valve 3 and an evaporator 4; a bypass flow control valve 6 that controls the amount of the refrigerant flowing through the bypass pipe 5; a heat exchanger 7 that allows heat exchange between the refrigerant that flows through the bypass pipe 5 after flowing out of the bypass flow control valve 6 and the refrigerant that flows through the circulation pipe after flowing out of the condenser 2; and a subcooling degree sensor T73 that detects the subcooling degree of the refrigerant at the inlet of the flow control valve 3. At least either the flow control valve 3 or the bypass flow control valve 6 is controlled so that the subcooling degree of the refrigerant at the inlet of the flow control valve 3 is equal to or greater than or a predetermined value.

21 Claims, 8 Drawing Sheets

(51) Int. Cl.

| | |
|---|---|
| ***F25B 41/00*** | (2006.01) |
| *F25B 40/06* | (2006.01) |
| *F24F 11/00* | (2006.01) |
| *F25B 40/02* | (2006.01) |

(52) U.S. Cl.

CPC ..... *F25B 40/06* (2013.01); *F25B 2341/063* (2013.01); *F25B 2341/064* (2013.01); *F25B 2400/0419* (2013.01); *F25B 2400/12* (2013.01); *F25B 2400/13* (2013.01); *F25B 2500/19* (2013.01); *F25B 2600/2509* (2013.01); *F25B 2700/21* (2013.01)

(56) References Cited

U.S. PATENT DOCUMENTS

| | | | | |
|---|---|---|---|---|
| 5,737,931 | A * | 4/1998 | Ueno et al. | 62/126 |
| 6,413,297 | B1 * | 7/2002 | Morgan et al. | 95/22 |
| 7,278,279 | B2 * | 10/2007 | Hirai et al. | 62/440 |
| 7,316,120 | B2 * | 1/2008 | Aoki et al. | 62/324.4 |
| 2006/0048539 | A1 * | 3/2006 | Takechi et al. | 62/513 |
| 2006/0133962 | A1 * | 6/2006 | Otani | 422/94 |
| 2007/0017249 | A1 * | 1/2007 | Otsuka et al. | 62/513 |

FOREIGN PATENT DOCUMENTS

| | | | |
|---|---|---|---|
| JP | 7 4756 | | 1/1995 |
| JP | 10 318614 | | 12/1998 |
| JP | 2936961 | B2 * | 8/1999 |
| JP | 2004 108312 | | 4/2004 |
| JP | 2004 175998 | | 6/2004 |
| JP | 2005 83609 | | 3/2005 |
| JP | 2006-199143 | A | 8/2006 |
| JP | 2008 51373 | | 3/2008 |

OTHER PUBLICATIONS

Office Action issued Jun. 5, 2012 in Chinese Patent application No. 200880129793.X (with English translation of its main text).

Japanese Office Action issued Dec. 18, 2012 in Patent Application No. 2010-516723 with English Translation.

Extended European Search Report issued Mar. 31, 2015 in Patent Application No. 08874614.4.

* cited by examiner

REFRIGERATION CYCLE DEVICE AND METHOD OF CONTROLLING THE SAME

TECHNICAL FIELD

The present invention relates to a refrigeration cycle device, and more particularly to a refrigeration cycle device that uses a refrigerant having a small Global Warming Potential.

BACKGROUND ART

A conventional refrigeration cycle device is formed by connecting the following components in the following order through refrigerant pipes: a compressor that compresses a medium-temperature low-pressure refrigerant (referred to as "medium-temperature/low-pressure," hereinafter for ease of explanation); a condenser that condenses the compressed refrigerant (referred to as "high-temperature/high-pressure refrigerant," hereinafter); an expansion valve that expands the condensed refrigerant (referred to as "medium-temperature/high-pressure refrigerant," hereinafter); and an evaporator that evaporates the expanded refrigerant (referred to as "low-temperature/low-pressure refrigerant," hereinafter). Hereinafter, such configuration is referred to as "main circuit." An invention is disclosed that cools the medium-temperature/high-pressure refrigerant to turn into a "supercooled (subcool)" state and then supplies the refrigerant to the expansion valve in order to increase a refrigerating effect at the load side (see Patent Document 1, for example).

On the other hand, the conventional refrigeration cycle device uses an incombustible HFC (Hydrofluorocarbon) refrigerant such as R410A. Therefore, the greenhouse effect of the refrigerant is about 2,000 times greater than that of carbon dioxide. It is indicated that if the refrigerant leaks by accident when the refrigeration cycle is for example disposed of or repaired, the refrigerant remains undecomposed and floating in the atmosphere for long periods of time, contributing to the acceleration of global warming.

Patent Document 1: Unexamined Patent Publication No. H06-331223 (Pages 3 to 4 and FIG. 1)

SUMMARY OF INVENTION

Technical Problem

According to the invention disclosed in Patent Document 1, a bypass pipe (which is the same as a shortcut pipe that directly connects the upstream side of the expansion valve to the upstream side of the compressor) is provided to bypass the expansion valve and the evaporator, and a bypass expansion valve is also provided on the bypass pipe, allowing heat exchange between the low-temperature/low-pressure refrigerant that has passed through the bypass expansion valve and the medium-temperature/high-pressure refrigerant that directly flows into the expansion valve to increase a refrigerating effect.

However, while the refrigeration cycle device disclosed in Patent Document 1 is able to increase the refrigerating effect, the greenhouse effect of the refrigerant is by no means taken into account.

As described above, if the HFC refrigerant leaks, the problem is that the refrigerant that has chemical stability remains undecomposed, floating in the atmosphere for long periods of time to exhibit a greenhouse effect. Therefore, in terms of protecting the earth's environment, it is desirable that a refrigerant having a small Global Warming Potential (referred to as "GWP," it is the same as a possibility of global warming. Hereinafter: The GWP is a measure of the greenhouse effect of a given gas in comparison with that of carbon dioxide) be used, so that the refrigerant decomposes relatively faster when the refrigerant leaks in the atmosphere by accident. On the other hand, a refrigerant that decomposes faster in the atmosphere can easily react with oxygen in the atmosphere to decompose. Therefore, the problem is that the refrigerant is combustible in nature.

For the use of the combustible refrigerants, conditions, including the followings, have been specified according to how easily the refrigerants could burn: the air-conditioning area of the refrigeration cycle device, the specifications of ventilation equipment, the presence or absence of the ventilation equipment, or the like. For example, in the international standard, if there is no restriction on the installation, it is determined that the amount of the filled refrigerant (referred to as "permissible amount of refrigerant," hereinafter) is less than or equal to:

Permissible amount of refrigerant [kg]=Lean flammability limit [kg/m$^3$]×4 [m$^3$]

For example, the permissible amount of refrigerant of a highly combustible propane (whose GWP is about one six-hundredth of R410A) is approximately 150 g; the permissible amount of refrigerant of the weakly combustible dichloromethane or tetrafluoropropylene is about 1,200 g.

Therefore, the use of refrigerants having lower GWPs (referred to as "low-GWP refrigerants," hereinafter) is limited to household refrigerators and the like that use a very small amount of refrigerant. When a combustible refrigerant having a low lower-limit flammability is used, it is not possible to fill the refrigeration cycle device with the originally required amount of the refrigerant to exhibit a required refrigeration capability when considering the case in which the combustible refrigerant may leak by accident into an air-conditioned space where an indoor unit is installed or into an indoor space where a refrigeration unit such as a showcase is installed. Accordingly, the amount of the refrigerant in the refrigeration cycle device is not sufficient in comparison with the conventional HFC refrigerant. The subcooling state does not happen at the outlet of the condenser, and the refrigerant flows into the expansion valve in a gas-liquid two-phase state. Moreover, the difference in pressure between the outlet and inlet of the expansion valve changes as the gas and the liquid unevenly flow through the throat section of the expansion valve in terms of time. Therefore, the problem is that the operation of the refrigeration cycle device is unstable (Problem 1).

If gas density is small and the difference in density between a liquid phase and a gas phase (referred to as "gas density difference," hereinafter) is large in the case of a low-GWP refrigerant, the problem is that: the speed at which the refrigerant in a gas-liquid two-phase state flows in the evaporator increases if an attempt is made to secure a predetermined heat exchange efficiency in the evaporator that accepts the liquid in a gas-liquid two-phase state, evaporates the liquid, and cools air, water, and the like; and it is necessary to set a "pressure difference," the difference between the liquid pressure at the inlet and the gas pressure at the outlet of the evaporator, at a predetermined value in order to curb the decline in efficiency, which leads to a drop in performance as the pressure loss of the refrigerant in the evaporator increases (Problem 2).

The present invention has been made to solve the above problems 1 and 2. The object of the present invention is to provide a refrigeration cycle device and a method of controlling the same that can reduce the greenhouse effect that stems from the leakage of the refrigerant or the like and can control the amount of the flowing refrigerant in a stable manner to turn the refrigerant at the inlet of an expansion valve into a subcooling state even when the refrigeration cycle device is operated in a way that turns the refrigerant at the outlet of a condenser into a gas-liquid two-phase state.

Another object of the present invention is to provide a refrigeration cycle device and a method of controlling the same that can prevent an increase in pressure loss of an evaporator and can set an "evaporator pressure difference" between the liquid pressure at the inlet and the gas pressure at the outlet of the evaporator, to be the most appropriate value.

Solution to Problem

According to the present invention, a refrigeration cycle device includes: a compressor that compresses a combustible refrigerant; a condenser that condenses the combustible refrigerant compressed by the compressor; a heat exchanger that subcools the combustible refrigerant discharged from the condenser; an expansion valve that expands the combustible refrigerant subcooled by the heat exchanger; an evaporator that evaporates the combustible refrigerant expanded by the expansion valve; and control means that controls the amount of heat exchange by the heat exchanger in accordance with the temperature or pressure of the refrigerant between the condenser and the expansion valve.

Moreover, according to the present invention, a method of controlling a refrigeration cycle where a combustible or toxic refrigerant is used as refrigerant, a refrigerant pipe is exposed to a cooled space, and the amount of filled refrigerant is so limited that the concentration of the refrigerant is less than a combustible concentration or less than or equal to a permissible concentration of toxicity to human body when the refrigerant leaks and spreads in the cooled space includes: a detection step of detecting the state of the refrigerant condensed by a condenser; and a step of suppressing pressure pulsations ahead of the expansion valve by subcooling, on the basis of the state of the refrigerant detected by the detection step, the refrigerant that is in a gas-liquid two-phase state at the outlet side of the condenser because of a condensing pressure dependent on the amount of filled refrigerant in the refrigeration cycle.

Advantageous Effects of Invention

Therefore, the refrigeration cycle device of the present invention allows the refrigerant at the upstream side of the expansion valve to be in a subcooling state even when the refrigeration cycle device is operated in a way that decreases the amount of heat discharged from the condenser with a limit on the amount of the filled refrigerant because of combustibility of the refrigerant. Thus, the refrigeration cycle device can be operated in a stable manner.

Moreover, a superheat degree control section provided on a bypass pipe can prevent an increase in pressure loss in the evaporator.

REFERENCE SIGNS LIST

1: Compressor, 2: Condenser, 3: Expansion valve, 4: Evaporator, 5: Bypass pipe, 5*a*: Heat conduction tube, 5*b*: Heat conduction tube, 5*c*: Heat conduction tube, 5*d*: Heat conduction tube, 5*e*: On-off valve, 5*f*: On-off valve, 5*g*: Heat conduction tube, 5*h*: Heat conduction tube, 6: Bypass expansion valve, 7: Heat exchanger, 8: Gas-liquid separator, 9: Gas flow control valve, 10: Gas pipe, 11: Superheat degree control section, 12: High-temperature/high-pressure pipe, 23: Medium-temperature/high-pressure pipe, 34: Low-temperature/low-pressure pipe, 41: Medium-temperature/low-pressure pipe, 100: Refrigeration cycle device (First embodiment), 200: Refrigeration cycle device (Third embodiment), 300: Refrigeration cycle device (Fourth embodiment), P34: Evaporator inlet pressure sensor, P41: Evaporator outlet pressure sensor, P89: Gas flow control valve inlet pressure sensor, P91: Gas flow control valve outlet pressure sensor, T71: Superheat degree sensor, and T73: Subcooling degree sensor.

DESCRIPTION OF EMBODIMENTS

First Embodiment (Refrigeration Cycle)

Figure 1:
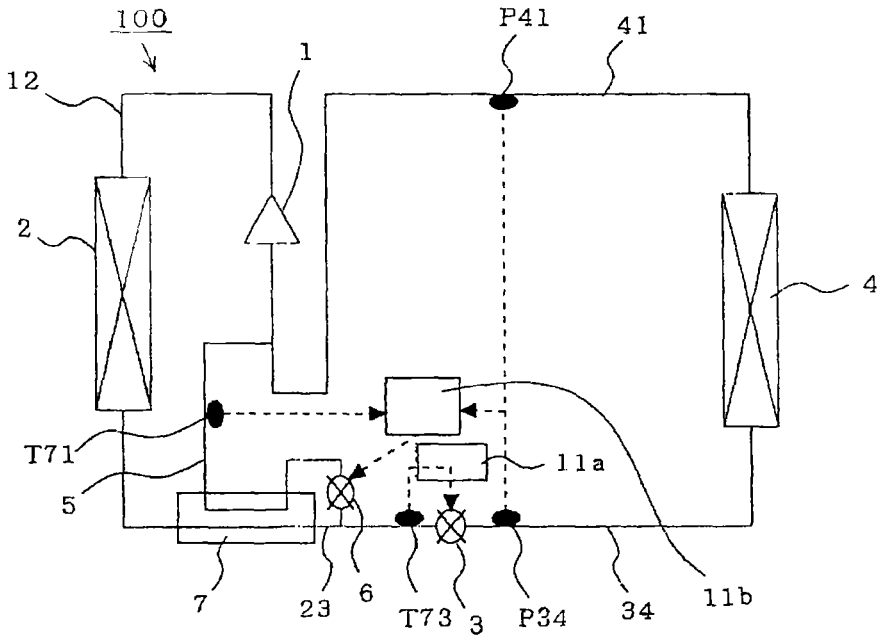
FIG. 1 is a refrigerant circuit diagram illustrating the configuration of a refrigeration cycle device according to a first embodiment of the present invention.

FIG. 1 is a refrigerant circuit diagram illustrating the configuration of a refrigeration cycle device according to a first embodiment of the present invention. In FIG. 1, the refrigeration cycle device 100 includes a main circuit that is equipped with a compressor 1 that compresses a refrigerant; a condenser 2 that condenses the compressed refrigerant; an expansion valve (a flow control valve such as an electronic expansion valve, a capillary tube, or the like) 3 that expands the condensed refrigerant; an evaporator 4 that evaporates the expanded refrigerant; a high-temperature/high-pressure pipe 12 that connects the compressor 1 to the condenser 2; a medium-temperature/high-pressure pipe 23 that connects the condenser 2 to the expansion valve 3; a low-temperature/low-pressure pipe 34 that connects the expansion valve 3 to the evaporator 4; and a medium-temperature/low-pressure pipe 41 that connects the evaporator 4 to the compressor 1.

In addition to the main circuit, the refrigeration cycle device 100 includes a bypass circuit that is equipped with a bypass pipe 5 which bypasses the expansion valve 3 and the evaporator 4 (which means that the downstream side of the condenser 2 is directly connected to the upstream side of the compressor 1) i.e., which connects the medium-temperature/high-pressure pipe 23 to the medium-temperature/low-pressure pipe 41; and a bypass expansion valve (a flow control valve such as electronic expansion valve, a capillary tube, or the like) 6 provided at the bypass pipe 5. (More precisely, the bypass circuit is part of a circuit but referred to as a "circuit" for ease of explanation.)

Incidentally, in the description here, "high, medium, and low temperatures" and "high and low pressures" that qualify the high-temperature/high-pressure pipe, the low-temperature/low-pressure refrigerant, and the like are just used for ease of explanation; the temperature or pressure categories are not distinguished by predetermined specific values. Moreover, the pressure of the high-temperature/high-pressure pipe 12 is the same as or different from the pressure of the medium-temperature/high-pressure pipe 23; the temperature of the medium-temperature/high-pressure pipe 23 is the same as or different from the temperature of the medium-temperature/low-pressure pipe 41. The pipes constituting the main circuit including the high-temperature/high-pressure pipe 12 are collectively referred to as "circulation pipe." Each of the pipes is also referred to as "circulation pipe."

The refrigeration cycle illustrated in FIG. 1 is applied to a household air conditioner, an industrial-use air conditioner including a plurality of indoor units, a refrigeration device installed in a showcase or refrigeration facility, and the like. A loading-side device having the evaporator 4 is provided in an air-conditioned space or in an indoor installation space which is a cooled space. The evaporator 4 and a connection pipe thereof are exposed to the cooled space through a grill and the like. A heat source-side device having the compressor 1, the condenser 2, the expansion valve 3, the bypass pipe 5, and the like is usually installed outside. The loading-side device and the heat source-side device are connected through a variety of pipes, including long and short ones, depending on installation conditions. Incidentally, the expansion valve 3 may be provided on the loading-side device instead of the heat source-side device.

When the amount of the filled refrigerant of the refrigeration cycle device is so designed as to assure safety in case the refrigerant leaks and spreads in the cooled space, the permissible amount of refrigerant is calculated by multiplying the capacity of the air-conditioned or cooled space by the lean flammability limit (lean flammability limit concentration) of the used refrigerant or by a toxic concentration permissible value that takes into account the impact on human body. Furthermore, in the design aimed for higher safety levels, the estimated capacity may be set at 4 [$m^3$], less than or equal to the capacity of the air-conditioned space, given that the refrigerant accumulates locally. Accordingly, there is a limit on the amount of refrigerant that fills up the refrigeration cycle device. In a conventional refrigeration cycle device, a sufficient amount of the filled refrigerant cannot be secured, probably resulting in a state in which the refrigerant in a gas-liquid two-phase state flows from the outlet of the condenser.

(Heat Exchanger)

Furthermore, provided is a heat exchanger 7 that carries out heat exchange between the medium-temperature/high-pressure refrigerant that flows through the medium-temperature/high-pressure pipe 23 and the refrigerant (also referred to as "bypass low-temperature/low-pressure refrigerant," hereinafter) that flows through the downstream portion of the bypass expansion valve 6 of the bypass pipe 5.

(Control Means)

In the main circuit, a subcooling degree sensor T73 (subcooling degree detection section) is provided at the upstream side of the expansion valve 3 (at the downstream side of the heat exchanger 7 of the medium-temperature/high-pressure pipe 23). The subcooling degree sensor T73 can be anything as long as the subcooling degree sensor T73 measures the subcooling degree of the refrigerant (primary stream) which flows through the medium-temperature/medium-pressure pipe 23. For example, the subcooling degree sensor T73 may be formed by a pressure sensor that detects the pressure of the refrigerant in the medium-temperature/medium-pressure pipe 23 and a temperature sensor that detects the temperature of the refrigerant. A subcooling degree control section 11*a* controls, in accordance with the value detected by the subcooling degree sensor T73, the opening of the expansion valve 3 and performs other processes to control the subcooling degree at the upstream side of the expansion valve 3.

An evaporator inlet pressure sensor P34 is provided at the upstream side of the evaporator 4 (at the downstream side of the expansion valve 3 of the low-temperature/low-pressure pipe 34); an evaporator outlet pressure sensor P41 is provided at the downstream side of the evaporator 4 (at the upstream side of the compressor 1 of the medium-temperature/low-pressure pipe 41).

In the bypass pipe 5, a superheat degree sensor T71 is provided at the downstream of the heat exchanger 7 (at the upstream of a merging point with the main circuit). The superheat degree sensor T71 (superheat degree detection section) can be anything as long as the superheat degree sensor T71 detects the superheat degree of the refrigerant (secondary stream) that flows through the bypass pipe 5. For example, the superheat degree sensor T71 is equipped with a temperature sensor at the cutlet-side bypass pipe 5 of the heat exchanger 7 to detect the temperature of the refrigerant; and a pressure sensor that measures the pressure of the refrigerant. The superheat degree sensor T71 measures the superheat degree from the detected values. A superheat degree control section 11*b* controls, in accordance with the value detected by the superheat degree sensor T71, the opening of the bypass expansion valve 6 and so on to control the superheat degree of the bypass pipe 5.

Incidentally, the subcooling degree control section 11*a* and the superheat degree control section 11*b* are part of control means that controls the refrigeration cycle device and are not necessarily separated as a device, and may be put together into one control device (a group of microcomputers and software groups).

(Refrigerant)

The refrigerant used in the refrigeration cycle device 100 is a refrigerant having a small GWP, a combustible refrigerant that has less greenhouse effect than the HFC refrigerant. For example, the major component of the refrigerant is propane, dichloromethane, chloromethane, difluoroethane, tetrafluoropropylene, or the like. Incidentally, the above "tetrafluoropropylene" means all types of tetrafluoropropylene, including a variety of isomers.

Second Embodiment

Control Method

Figure 2:
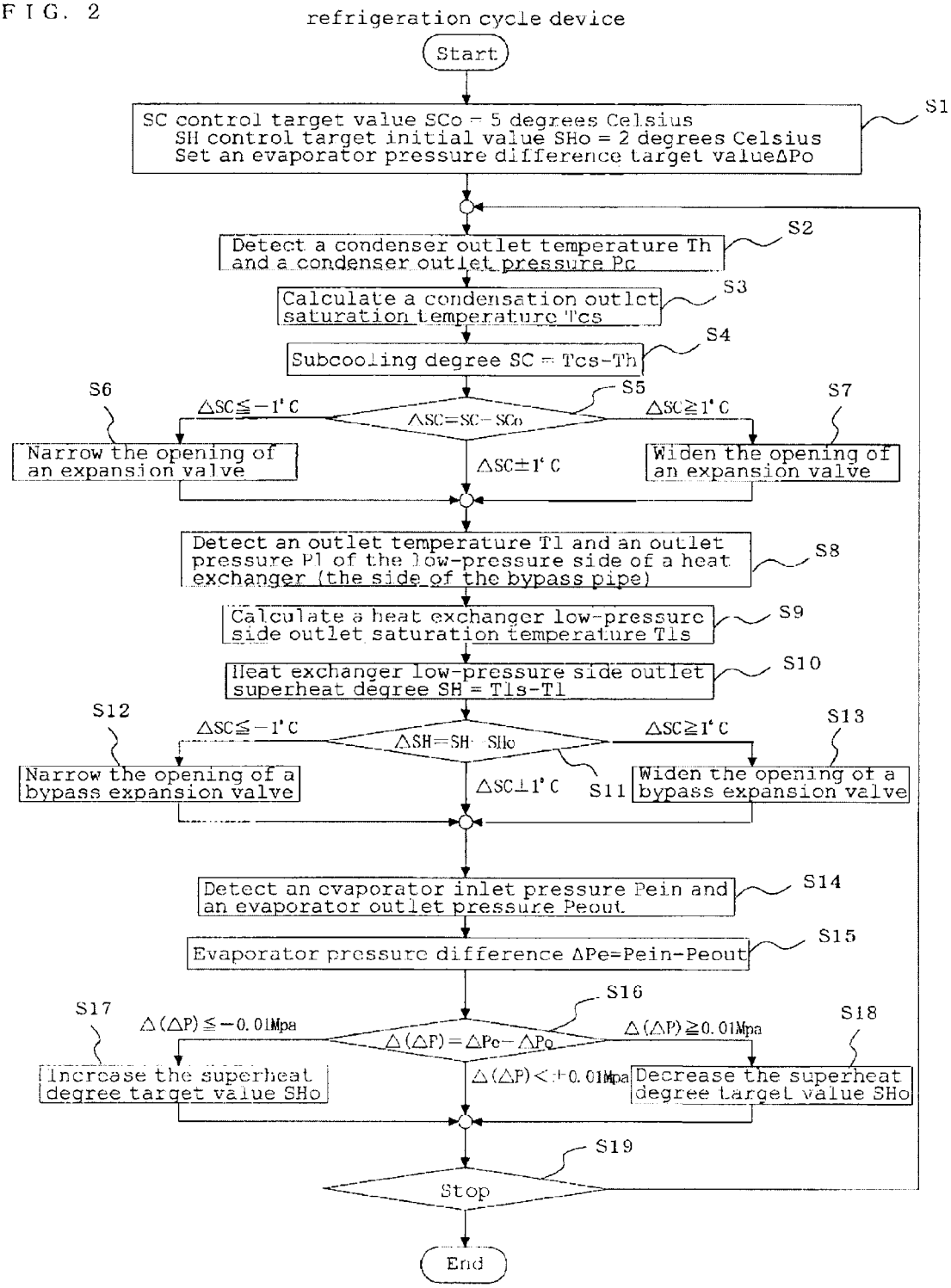
FIG. 2 is a flowchart illustrating a method of controlling a refrigeration cycle device according to a second embodiment of the present invention and showing a subcooling degree and superheat degree control process by a control means.

The following describes the control of the expansion valve 3 and the bypass expansion valve 6 by the control means of the refrigeration cycle device illustrated in the first embodiment, with reference to FIG. 2.

FIG. 2 is a flowchart showing the subcooling degree control and superheat degree control processes by the control means and is used to illustrate the method of controlling the refrigeration cycle device of the second embodiment of the present invention.

In FIG. 2, the subcooling degree control section 11*a* and the superheat degree control section 11*b* first set initial values (SCo=5 degrees Celsius and SHo=2 degrees Celsius, for example) as a subcooling degree target value SCo and a superheat degree target value SHo, respectively (S1). The initial values are those appropriately adjusted according to installation conditions and type of the refrigeration device (a positive value greater than or equal to zero) and are stored in advance in a nonvolatile memory or the like. The superheat degree control section 11*b* sets, as a evaporator pressure difference target value ΔPo, a value suitable for the system specifications of the refrigeration cycle device, i.e., the evaporator pressure difference target value ΔPo is so set as to increase (maximize) performance in accordance with the refrigeration capability of the evaporator in particular.

(Subcooling Degree Control)

Figure 4:
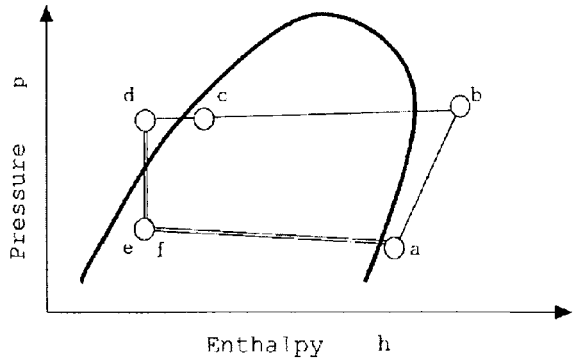
FIG. 4 is a p-h diagram (Mollier diagram) showing the transition of a refrigerant to explain the running operation of the refrigeration cycle device according to the first embodiment of the present invention.

The subcooling degree control section 11*a* then performs the subcooling degree control process as described below. The subcooling degree control section 11*a* acquires the detected values of a condenser outlet temperature Th and a condenser temperature outlet pressure Pc as information about the state of the refrigerant from the temperature and pressure sensors of the subcooling degree sensor T73 provided on a path extending from the heat exchanger 7 to the expansion valve 3 (at a more downstream side of the medium-temperature/high-pressure pipe 23 than a diverging point of the bypass pipe 5) (S2). The subcooling degree control section 11*a* calculates a condensation outlet saturation temperature Tcs on the basis of the acquired condenser temperature outlet pressure Pc (S3), and calculates the subcooling degree SC (−Tcs−Th) from the calculated value and the condenser outlet temperature Th (S4). Incidentally, as for the condensation outlet saturation temperature Tcs, points corresponding to a saturation liquid line from a p-h diagram, as illustrated in FIG. 4, may be recorded in advance on a table with Th and Pc as parameters. Alternatively, the condensation outlet saturation temperature Tcs may be calculated by substituting Th and Pc into a predetermined algorithm (calculation formula). Moreover, the condensation outlet saturation temperature Tcs may be determined by calculating a saturation temperature Tc from the temperature of the gas-liquid two-phase portion in the condenser 2.

Then, the subcooling degree control section 11*a* controls the subcooling degree of the refrigerant on the basis of the difference between the detected subcooling degree SC and the subcooling degree target value SCo (S5 to 7). More specifically, the subcooling degree control section 11*a* calculates the difference ΔSC (=SC−SCo) between the subcooling degree SC and the target value (S5). When the subcooling degree SC is less than the target value (ΔSC≤−1 degree Celsius, for example), the subcooling degree control section 11*a* narrows the opening of the expansion valve 3 so that the current opening is adjusted to be a slightly smaller opening (S6). On the other hand, when the subcooling degree SC is greater than the target value (ΔSC≥1 degree Celsius, for example), the subcooling degree control section 11*a* widens the opening of the expansion valve 3 (S7). When the subcooling degree SC is close to the target value, the subcooling degree control section 11*a* proceeds to the subsequent superheat degree control process without performing any other processes.

According to the above subcooling degree control process, when the subcooling degree is smaller than a predetermined value, the subcooling degree control section 11*a* narrows the opening of the expansion valve 3 to increase the difference in pressure between the outlet and inlet of the expansion valve, leading to an increase in the condenser outlet pressure Pc. Therefore, the difference in temperature between the refrigerant and a heated medium in the condenser 2 and the heat exchanger increases, leading to a drop in temperature of the medium-temperature/high-pressure refrigerant in the condenser 2 and the heat exchanger 7 and to an increase in the amount of cold heat exchanged by the heat exchanger 7. Thus, the subcooling degree increases as the temperature of the medium-temperature/high-pressure refrigerant decreases. On the other hand, when the subcooling degree is greater than the predetermined value, the reverse takes place in operation, lowering the subcooling degree of the medium-temperature/high-pressure refrigerant. In that manner, since the refrigerant that is in a gas-liquid two-phase state at the outlet of the condenser due to an insufficient amount of the filled refrigerant in the refrigeration cycle or the like is subcooled, pressure pulsations caused by the gas and liquid phases that alternately appear when the refrigerant passes through the expansion valve 3 can be effectively reduced.

(Superheat Degree Control)

The control means then uses the superheat degree control section 11*b* to perform the superheat degree control process as described below. The superheat degree control section 11*b* acquires the detected values of an outlet temperature T1 and outlet pressure P1 of the low-pressure side of the heat exchanger 7 as information on the state of the refrigerant from the temperature and pressure sensors of the superheat degree sensor T71 (S8). The superheat degree control section 11*b* then acquires a low-pressure side outlet saturation temperature T1*s* of the heat exchanger 7 from the outlet pressure P1 of the low-pressure side of the heat exchanger (S9) and detects a low-pressure side outlet superheat degree SH (SH=T1*s*−T1) of the heat exchanger 7 (S10). In a similar way to the condenser saturation temperature Tcs, the saturation temperature T1*s* is calculated from T1 and P1 on a basis of the p-h diagram or from a predetermined calculation algorithm.

Subsequently, the superheat degree control section 11*b* controls the superheat degree of the refrigerant on the basis of the difference between the detected superheat degree SH and the superheat degree target value SHo (S11 to 13). More specifically, the superheat degree control section 11*b* calculates the difference ΔSH (=SH−SHo) between the superheat degree SH and the target value (S11). When the superheat degree SH is less than the target value (ΔSH≤−1 degree Celsius, for example), the superheat degree control section 11*b* narrows the opening of the bypass expansion valve 6 so that the current opening is adjusted to be a slightly smaller opening (S12). On the other hand, when the superheat degree SH is greater than the target value (ΔSH≥1 degree Celsius, for example), the superheat degree control section 11*b* widens the opening of the bypass expansion valve 6 (S13). When the superheat degree SH is close to the target value, the superheat degree control section 11*b* proceeds to a subsequent superheat degree target value control process without performing any other processes.

Performing the above superheat degree control process stops the liquid refrigerant from returning to the compressor 1. Furthermore, performing a process of adjusting the superheat degree target as described below can reduce problems of pressure losses that occur in the evaporator 4 and an extension pipe.

(Superheat Degree Target Value Control)

The following describes a superheat degree target value control process. The control means performs the superheat degree target value control process to reduce pressure losses after the superheat degree control process. The superheat degree control section 11*b* first acquires the detected value of an evaporator inlet pressure (Pein) from an evaporator inlet pressure sensor P34 installed on a path (the low-temperature/low-pressure pipe 34) leading to the evaporator 4, and the detected value of an evaporator outlet pressure (Peout) from an evaporator outlet pressure sensor P41 installed on a path (the medium-temperature/low-pressure pipe 41) extending from the evaporator 4 to the compressor 1 (S14). Incidentally, the values may be acquired by a method of calculating a saturation pressure from the inlet temperature of the evaporator.

An evaporator pressure difference ΔPe (ΔPe=Pein−Peout) is detected from the detected values (S15). The superheat degree target value is so controlled as to bring the evaporator pressure difference ΔPe closer to an evaporator pressure difference target value ΔPo. That is, the superheat degree control section 11*b* makes a determination as to the difference between the evaporation pressure difference ΔP and the target value, or Δ(ΔP)=ΔPe−ΔPo (S16). When the difference Δ(ΔP) is less than a predetermined value (Δ(ΔP)≤−0.01 Mpa), the superheat degree control section 11*b* increases the superheat degree target value SHo by a predetermined value (1 degree Celsius, for example) (S17). When the difference Δ(ΔP) is greater than a predetermined value (ΔP≥0.01 Mpa), the superheat degree control section 11*b* decreases the superheat degree target value SHo by a predetermined value (1 degree Celsius, for example). When the evaporation pressure difference ΔP is close to the target value, the superheat degree control section 11*b* keeps the current superheat degree target value SHo and ends the superheat degree target value control process.

After completing the superheat degree target value control process, the control means checks whether there is an operation stop command from operational switches or networks (not shown) to determine whether to stop the operation (S19). When the control means does not stop the operation, the control means returns to step S2 to repeat the above-described subcooling control process, superheat degree control process, and superheat degree target control process.

According to the superheat degree target control process, the superheat degree target value SHo is set smaller as the evaporator pressure difference ΔP becomes larger than the target value. Therefore, the opening of the bypass expansion valve 6, under the control of the superheat degree control process, is widened, leading to an increase in the amount of refrigerant flowing through the bypass pipe 5. Thus, the amount of the refrigerant (the low-temperature/low-pressure refrigerant that has passed through the expansion valve 3) flowing through the main circuit decreases accordingly. As a result, the evaporator inlet pressure Pein decreases, thereby reducing the pressure losses.

Incidentally, according to the above description, the following method is applied: The adjustable range of a superheat degree target value SHo is a fixed value and adjusted little by little in accordance with situations. However, the following method is also possible: As the evaporator pressure difference (ΔP=Pein−Peout), the difference between the evaporator inlet pressure (Pe) and the evaporator outlet pressure (Pa), becomes larger, the superheat degree target value SHo may be set smaller (i.e. adjustable range is increased) to increases the opening of the bypass expansion valve 6 under the control of the superheat degree control process; if the evaporator pressure difference (ΔP) is small, the superheat degree target value SHo is set larger than the current superheat degree and the opening of the bypass expansion valve 6 is throttled to reduce an excessive flow of the refrigerant.

(Running Operation)

The following describes the running operation of the refrigeration cycle device 100 illustrated in the first embodiment.

Figure 3:
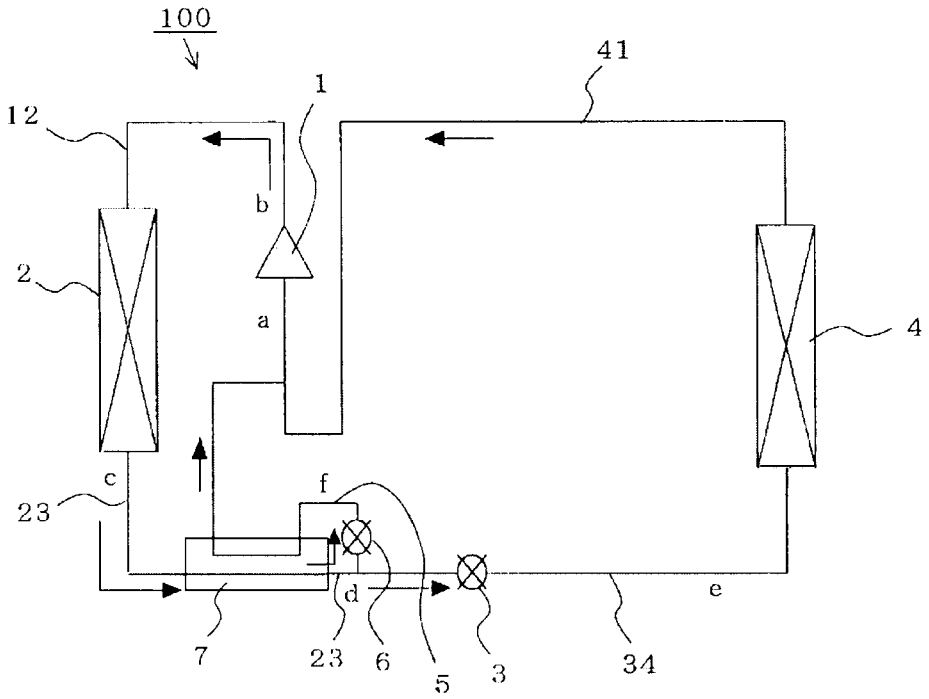
FIG. 3 is a refrigerant circuit diagram showing the flow of a refrigerant to explain the running operation of the refrigeration cycle device according to the first embodiment of the present invention.

FIGS. 3 and 4 are used to describe the running operation of the refrigeration cycle device according to the first embodiment of the present invention. FIG. 3 is a refrigerant circuit diagram illustrating the flow of the refrigerant. FIG. 4 is a p-h diagram (Mollier diagram) showing the transition of the refrigerant. Incidentally, in FIGS. 1 to 4, the same portions have been denoted by the same reference symbols, and some of the portions will not be described. The refrigerant states (a) to (f) illustrated in FIG. 4 are the refrigerant states of the locations (a) to (f) in FIG. 3, respectively.

(Compression Operation)

First, the medium-temperature/low-pressure refrigerant in the state of vapor is compressed by the compressor 1 and discharged as high-temperature/high-pressure refrigerant in the state of vapor. If there is no heat transfer to or from the surrounding area, the refrigerant compression process of the compressor 1 is represented by an entropy line, such as a line extending from the state (a) to the state (b) in FIG. 4.

(Condensation Operation)

The high-temperature/high-pressure refrigerant discharged from the compressor flows into the condenser 2 where the high-temperature/high-pressure refrigerant condenses into a medium-temperature/high-pressure refrigerant in a gas-liquid two-phase state while radiating heat to the air and water. The change of the refrigerant in the condenser occurs under a substantially constant level of pressure. Given the pressure losses from the pipe resistance of the condenser, the change of the refrigerant is represented by a straight line extending from the state (b) to the state (c) in FIG. 4 which is nearly horizontal and slightly leans.

(Subcooling Operation)

The medium-temperature/high-pressure refrigerant output from the condenser 2 in a gas-liquid two-phase state flows into the heat exchanger 7 where the medium-temperature/high-pressure refrigerant further condenses into a liquid medium-temperature/high-pressure refrigerant through heat exchange with the low-temperature/low-pressure refrigerant flowing through the bypass pipe 5 (through a process of receiving cold heat from the refrigerant that has expanded at the bypass expansion valve 6). The change of the medium-temperature/high-pressure refrigerant in the heat exchanger 7 occurs under a substantially constant level of pressure. Given the pressure losses from the heat exchanger 7, the change of the refrigerant is represented by a straight line extending from the state (c) to the state (d) in FIG. 4 which is nearly horizontal and slightly leans.

(Expanding Operation)

Part of the liquid medium-temperature/high-pressure refrigerant flows into the bypass pipe 5 and is narrowed at the bypass expansion valve 6 to expand (decompression) to be in a low-temperature/low-pressure gas-liquid two-phase state. The change of the refrigerant at the bypass expansion valve 6 occurs under a constant level of enthalpy. The change of the refrigerant is represented by a vertical line extending from the state (d) to the state (f) in FIG. 4.

Meanwhile, the rest of the liquid medium-temperature/high-pressure refrigerant that comes out from the heat exchanger 7 but does not flow into the bypass pipe 5 is narrowed at the expansion valve 3 to expand (decompression) to be in a low-temperature/low-pressure gas-liquid two-phase state. The change of the refrigerant at the expansion valve 3 occurs under a constant level of enthalpy. The change of the refrigerant is represented by a vertical line extending from the state (d) to the state (e) in FIG. 4.

(Evaporation Operation)

The low-temperature/low-pressure refrigerant that comes out from the bypass expansion valve 6 in a gas-liquid two-phase state flows into the heat exchanger 7 where the low-temperature/low-pressure refrigerant turns into a medium-temperature/low-pressure refrigerant in the state of vapor after the refrigerant is deprived of cold heat through heat exchange with the medium-temperature/high-pressure refrigerant coming out from the condenser 2. The change of the low-temperature/low-pressure refrigerant in the heat exchanger 7 occurs under a substantially constant level of pressure. Given the pressure losses from the heat exchanger 7, the change of the refrigerant is represented by a straight line extending from the state (f) to the state (a) in FIG. 4 which is nearly horizontal and slightly leans.

Meanwhile, the low-temperature/low-pressure refrigerant that comes out from the expansion valve 3 in a gas-liquid two-phase state flows into the evaporator 4 where the low-temperature/low-pressure refrigerant turns into a gas, or a medium-temperature/low-pressure refrigerant in the state of vapor, as the refrigerant evaporates through heat exchange with the air. The change of the refrigerant in the evaporator 4 occurs under a substantially constant level of pressure. Given the pressure losses from the evaporator 4, the change of the refrigerant is represented by a straight line extending from the state (e) to the state (a) in FIG. 4 which is nearly horizontal and slightly leans.

(Drop in Pressure)

The medium-temperature/low-pressure refrigerant in the state of vapor that comes out from the evaporator 4 mixes with the refrigerant that comes out from the bypass pipe 5 in the state of vapor, and flows into the compressor 1 where the refrigerant is compressed.

Incidentally, since the medium-temperature/low-pressure refrigerant in the state of vapor that is just about to flow into the compressor 1 passes through the medium-temperature/low-pressure pipe 41, the pressure slightly decreases compared with the medium-temperature/low-pressure refrigerant that has just come out from the evaporator 4. However, both the refrigerants are represented by the same state (a) in FIG. 4. Similarly, since the liquid medium-temperature/high-pressure refrigerant that is just about to flow into the expansion valve 3 radiates a very little amount of heat while passing through between the heat exchanger 7 of the medium-temperature/high-pressure pipe 23 and the expansion valve 3, the pressure of the liquid medium-temperature/high-pressure refrigerant slightly decreases compared with the medium-temperature/high-pressure liquid that has just come out from the heat exchanger 7. However, both the refrigerants are represented by the same state (c) in FIG. 4.

Similarly, such pressure losses, including a drop in pressure of the refrigerant as the refrigerant passes through pipes, also occur in the embodiments described below and therefore will be described only when necessary.

(Flow Control)

As described above, when the low-GWP refrigerant used in the refrigeration cycle device has the characteristics of combustibility or low combustibility, the permissible amount of refrigerant is suppressed and the amount of heat exchanged by the condenser 2 (the length of the pipe and the like) is small. Therefore, the medium-temperature/high-pressure refrigerant at the outlet of the condenser 2 may be in a gas-liquid two-phase state.

However, even when the refrigeration cycle device 100 having the above configuration is operated in such a way that the medium-temperature/high-pressure refrigerant at the outlet of the condenser 2 can be in a gas-liquid two-phase state, the refrigeration cycle device 100 can be controlled to have the medium-temperature/high-pressure refrigerant subcooled at the expansion valve 3 and at the inlet of the bypass expansion valve 6. Therefore, the refrigeration cycle device 100 can carry out the stable flow control (expansion) of the refrigerant.

The stable flow control is attributable to the difference in heat exchange capability per unit volume of refrigerant between the condenser 2, which carries out heat exchange between the high-temperature/high-pressure refrigerant and the air or the like, and the heat exchanger 7, which carries out heat exchange between the medium-temperature/high-pressure refrigerant and the low-temperature/low-pressure refrigerant. For example, when the refrigeration cycle device 100 is operated in the summer months, the difference in temperature between the high-temperature/high-pressure refrigerant and the air in the condenser 2 is about 5 to 15 degrees Celsius, while the difference in temperature between the medium-temperature/high-pressure refrigerant and the low-temperature/low-pressure refrigerant in the heat exchanger 7 is about 30 to 40 degrees Celsius. Therefore, the amount of heat exchanged by the heat exchanger 7 per unit area is about 2 to 8 times greater than that of the condenser 2. Therefore, it is possible to carry out a large scale of heat exchange with a smaller amount of the refrigerant and to increase the subcooling degree of the medium-temperature/high-pressure refrigerant despite the short pipes.

Moreover, if the passage of the refrigerant through the expansion valves 3 and 7 leads to the alternate occurrence of gas and liquid phases, pressure pulsations emerge due to the difference in passage resistance, such as orifice, between gas and liquid phases. The pressure pulsations lead to a decrease in performance of the refrigeration cycle device due to an increase in sound level of the flowing refrigerant and an increase in pressure loss. If the pressure pulsations are large, the pressure pulsations intermittently put a burden on the compressor 1, the condenser 2, the expansion valve 3, the heat exchanger 7, and the connection pipes and connection sections of the compressor 1, the condenser 2, the expansion valve 3, and the heat exchanger 7. Therefore, there is concern that the fatigue of the connection sections and the like will occur and lead to the leakage of the refrigerant due to the pressure pulsations. When combustible or toxic refrigerants are used as operational refrigerants, a measure to prevent the leakage of the refrigerant is very important and the durability of the components needs to be enhanced. According to the subcooling control process of the present embodiment, the expansion valves 3 and 7 suppress the pressure pulsations and effectively reduce the risk that the refrigerant will leak. Moreover, given an already high level of safety, it is not necessary to excessively increase the durability of the pipe connection sections and the like.

Moreover, according to the present embodiment, an increase in evaporator pressure difference (ΔP; the difference in pressure between the inlet and outlet of the evaporator 4) can be suppressed.

Furthermore, when the amount of the refrigerant flowing in the evaporator 4 decreases, it is possible to decrease the amount of the refrigerant flowing through the bypass pipe 5. Therefore, the decline in heat exchange capability of the evaporator 4 is suppressed, leading to the effect that the refrigeration cycle device 100 can be efficiently operated.

The target value of the superheat degree is set based on the evaporator pressure difference (ΔP) with the use of the evaporator inlet pressure sensor P34 and the evaporator outlet pressure sensor P41 as described in the first embodiment. However, the present invention is not limited to this. A similar effect can be for example obtained even when the target value of the superheat degree is set based on the frequency of the compressor 1 and the inlet pressure of the compressor 1 or the like.

Moreover, in the first embodiment, as for the subcooling degree sensor T73 and the superheat degree sensor T71, a similar effect can be for example obtained even when the superheat degree is calculated from the saturation temperature and outlet temperature in the condenser 2 or heat exchanger 7.

Incidentally, according to the above embodiments, the subcooling degree control process is performed by controlling the opening of the expansion valve 3. However, the subcooling degree control process is not limited to the above method. The subcooling degree control process may be performed by adjusting the opening of the bypass expansion valve 6 or by controlling the rotational frequency of the compressor 1. The adjustment of the opening of the bypass expansion valve 6 or the controlling of the rotational frequency of the compressor 1 may be performed together with the controlling of the rotation frequency of a fan of the condenser 2.

Moreover, the superheat degree control process is not limited to the method of adjusting the opening of the bypass expansion valve 6. The superheat degree control process may be performed by adjusting the opening of the expansion valve 3 or by controlling the rotational frequency of the compressor 1. The adjustment of the opening of the expansion valve 3 or the controlling of the rotational frequency of the compressor 1 may be performed together with the controlling of the rotation frequency of the fan of the condenser 2.

When the subcooling degree control process is performed, it is possible that the subcooling degree is controlled by the bypass expansion valve 6 and the like while a narrowing device such as capillary tube is used for the expansion valve 3. The expansion valve 3 may be a thermal expansion valve; it is possible that a temperature sensitive cylinder detects temperatures at the upstream-side tube of the thermal expansion valve and at other portions to physically drive the opening of the thermal expansion valve. In this case, the thermal expansion valve and the bypass expansion valve 6 whose opening is controlled by the control means are used in combination to perform the subcooling degree control process.

Instead, it is possible that a narrowing device such as capillary tube whose opening is constant is used for the bypass expansion valve 6 and the subcooling control process is performed by the expansion valve 3. The bypass expansion valve 6 may be a thermal expansion valve.

When the subcooling degree control process and the superheat degree control process are performed with the opening of either the expansion valve 3 or the bypass expansion valve 6, the subcooling control process may be prioritized with greater importance given to the controlling of pressure pulsations and the like. Alternatively, the superheat degree control process may be performed with greater importance given to the reduction in pressure losses.

Each of the setting values described in the flowchart in FIG. 2 is one example, and appropriate values may be set according to the specifications of the system, the estimated use conditions, and the like.

Moreover, it is more desirable that the evaporator pressure difference target value ΔPo be a value that varies according to the current refrigeration capability of the evaporator 4 and be dynamically calculated from the frequency of the compressor and the air capacity of the evaporator (the rotation frequency of the fan), not a fixed value. In this case, the superheat degree control section 11*b* sets the evaporator pressure difference target value ΔPo in line with the current refrigeration capability before the step S16 of FIG. 1*a*.

Third Embodiment (Refrigeration Cycle)

Figure 5:
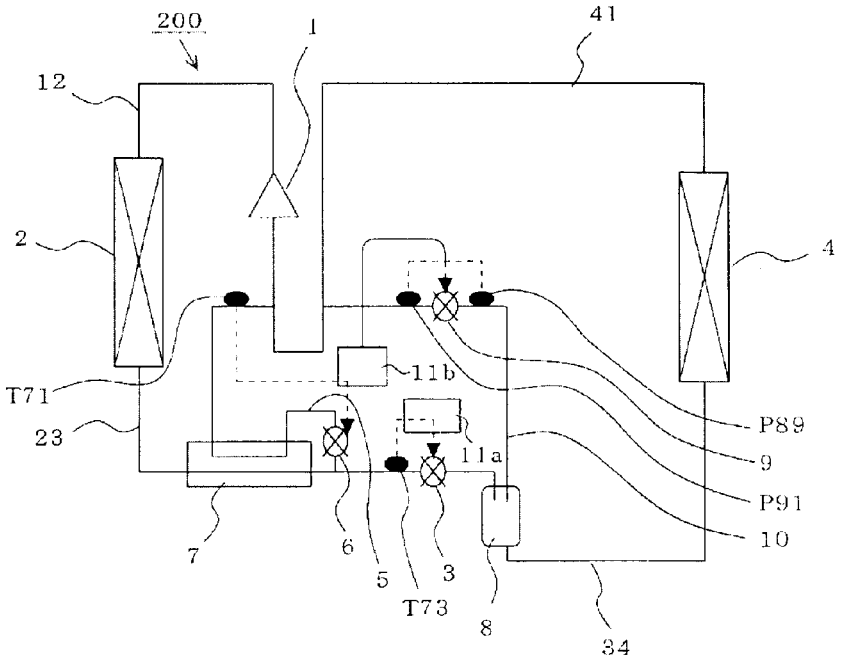
FIG. 5 is a refrigerant circuit diagram illustrating the configuration of a refrigeration cycle device according to a third embodiment of the present invention.

FIG. 5 is a refrigerant circuit diagram illustrating the configuration of a refrigeration cycle device according to a third embodiment of the present invention. In FIG. 5, a refrigeration cycle device 200 is formed by adding a gas-liquid separator 8 to the low-temperature/low-pressure pipe 34 of the refrigeration cycle device 100 (First Embodiment) and providing a pipe (referred to as "gas pipe," hereinafter) 10 that supplies a gas (vapor) separated by the gas-liquid separator 8 to the compressor 1.

A flow control valve (referred to as "gas flow control valve," hereinafter) 9 is provided midway of the gas pipe 10. A gas flow control valve inlet pressure sensor P89 and a gas flow control valve outlet pressure sensor P91 are provided at the upstream and downstream sides of the gas flow control valve 9, respectively.

Incidentally, the configuration of the other portions is the same as that of the refrigeration cycle device 100 (First Embodiment). Therefore, the portions have been denoted by the same reference symbols and will not be described.

(Bypass Pipe)

That is, the bypass expansion valve 6 is provided on the bypass pipe 5 that bypasses the expansion valve 3 and the evaporator 4. Part of the bypass pipe 5 forms the heat exchanger 7 at the downstream side of the bypass expansion valve 6. The superheat degree sensor T71 is provided at the downstream side of the heat exchanger 7 of the bypass pipe 5. The bypass pipe 5 equipped with the above components is the same as the bypass pipe 5 of the refrigeration cycle device 100.

(Gas Pipe)

The gas-liquid separator 8 is to separate the low-temperature/low-pressure refrigerant that has flowed out of the expansion valve 3 into vapor and liquid. The separated vapor is transferred to the gas pipe 10 and the separated liquid to the evaporator 4 via the low-temperature/low-pressure pipe 34.

The gas flow control valve 9 is provided midway of the gas pipe 10. The upstream-side gas flow control valve inlet pressure sensor P89 detects the pressure of the vapor separated by the gas-liquid separator 8. The downstream-side gas flow control valve outlet pressure sensor P91 detects the pressure of the refrigerant expanded by the gas flow control valve 9.

(Control Procedure)

The following describes the operation of the expansion valve 3, the bypass expansion valve 6, and the gas flow control valve 9.

The controlling by the expansion valve 3 is such that the subcooling degree of the medium-temperature/high-pressure refrigerant detected by the subcooling degree sensor T73 installed at the downstream of the heat exchanger 7 on the path (a portion of the medium-temperature/high-pressure pipe 23) from the heat exchanger 7 to the expansion valve 3 is greater than or equal to a predetermined value. That is, when the subcooling degree is less than the predetermined value, the opening of the expansion valve 3 is throttled. On the other hand, when the subcooling degree is greater than the predetermined value, the opening is widened.

The controlling by the bypass expansion valve 6 is in accordance with the superheat degree of the low-temperature/low-pressure refrigerant detected by the superheat degree sensor T71 at the downstream side of the heat exchanger 7 of the bypass pipe 5. The opening of the bypass expansion valve 6 is narrowed as the superheat degree decreases. The opening is widened as the superheat degree increases.

The controlling by the gas flow control valve 9 is in accordance with a pressure value (p1) and a pressure value (p2) detected by the gas flow control valve inlet pressure sensor P89 and the gas flow control valve outlet pressure sensor P91, respectively, which are provided at the front and rear sides (outlet and inlet) of the gas flow control valve 9, respectively.

That is, the difference in pressure between the both (referred to as "gas flow control valve pressure difference," hereinafter for ease of explanation) $\Delta p$ is calculated. As the gas flow control valve pressure difference ($\Delta p = p1 - p2$) increases, the opening of the gas flow control valve 9 is widened. As the gas flow control valve pressure difference decreases, the opening of the gas flow control valve 9 is narrowed.

(Running Operation)

The following describes the running operation of the refrigeration cycle device 200.

Figure 6:
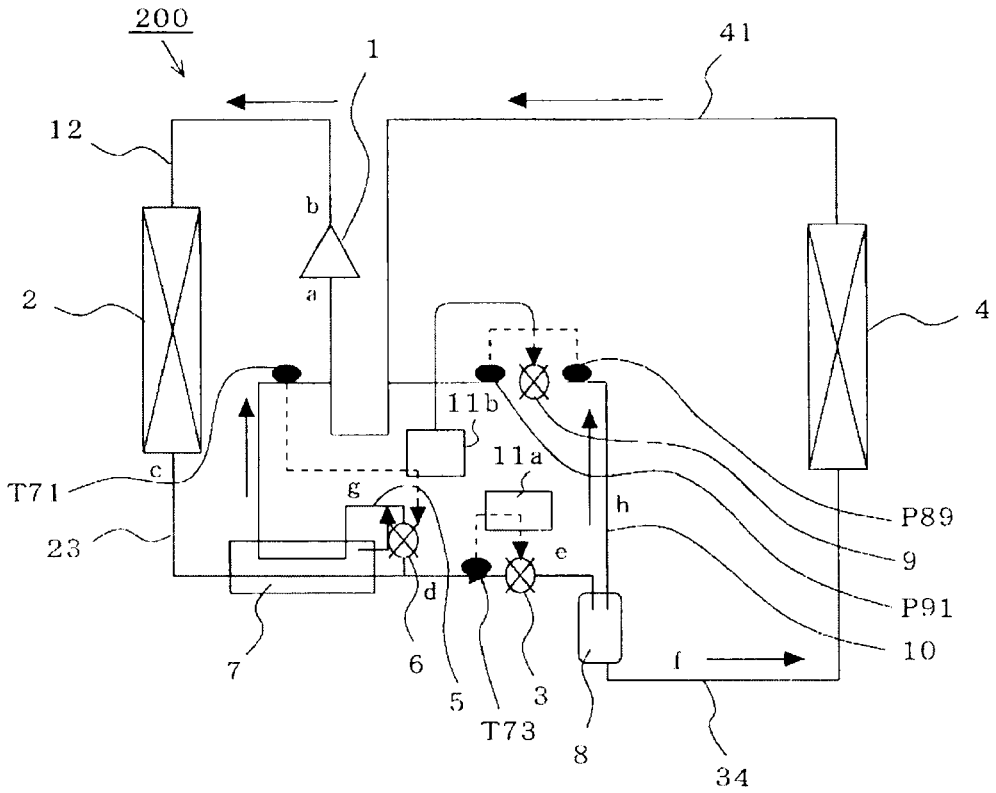
FIG. 6 is a refrigerant circuit diagram showing the flow of a refrigerant to explain the running operation of the refrigeration cycle device according to the third embodiment of the present invention.
Figure 7:
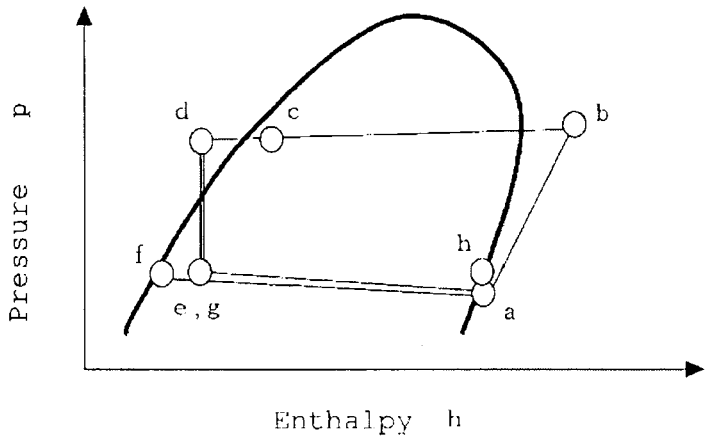
FIG. 7 is a p-h diagram (Mollier diagram) showing the transition of a refrigerant to explain the running operation of the refrigeration cycle device according to the third embodiment of the present invention.

FIGS. 6 and 7 are used to describe the running operation of the refrigeration cycle device according to the third embodiment of the present invention. FIG. 6 is a refrigerant circuit diagram illustrating the flow of the refrigerant. FIG. 7 is a p-h diagram (Mollier diagram) showing the transition of the refrigerant. Incidentally, the same portions as those in FIG. 5 have been denoted by the same reference symbols, and some of the portions will not be described. The refrigerant states (a) to (h) illustrated in FIG. 7 are the refrigerant states of the locations (a) to (h) in FIG. 6, respectively.

(Compression Operation)

First, the medium-temperature/low-pressure refrigerant in the state of vapor is compressed by the compressor 1 and discharged as high-temperature/high-pressure refrigerant. If there is no heat transfer to or from the surrounding area, the refrigerant compression process of the compressor 1 is represented by an entropy line, such as a line extending from the state (a) and the state (b) in FIG. 7.

(Condensation Operation)

The high-temperature/high-pressure refrigerant discharged from the compressor 1 flows into the condenser 2 where the high-temperature/high-pressure refrigerant condenses into a medium-temperature/high-pressure refrigerant in a gas-liquid two-phase state while radiating heat to the air and water (heat radiation). The change of the refrigerant in the condenser 2 occurs under a substantially constant level of pressure. Given the pressure losses from the condenser, the change of the refrigerant is represented by a straight line extending from the state (b) to the state (c) in FIG. 7 which is nearly horizontal and slightly leans.

(Heat Exchange Operation)

The medium-temperature/high-pressure refrigerant that comes out from the condenser 2 in a gas-liquid two-phase state flows into the heat exchanger 7 where the medium-temperature/high-pressure refrigerant further condenses into a liquid medium-temperature/high-pressure refrigerant, whose temperature is lower than the medium-temperature/high-pressure refrigerant in a gas-liquid two-phase state, through heat exchange with the low-temperature/low-pressure refrigerant flowing through the bypass pipe 5 (through a process of receiving cold heat). The change of the medium-temperature/high-pressure refrigerant in the heat exchanger 7 occurs under a substantially constant level of pressure. Given the pressure losses from the heat exchanger 7, the change of the refrigerant is represented by a straight line extending from the state (c) to the state (d) in FIG. 7 which is nearly horizontal and slightly leans.

(Expanding Operation by Bypass Pipe)

Part of the liquid medium-temperature/high-pressure refrigerant that has flowed out of the heat exchanger 7 flows into the bypass pipe 5. The part of the liquid medium-temperature/high-pressure refrigerant is then narrowed at the bypass expansion valve 6 to expand (decompression) and turns into a low-temperature/low-pressure refrigerant in a gas-liquid two-phase state. The change of the refrigerant at the bypass expansion valve 6 occurs under a constant level of enthalpy. The change of the refrigerant is represented by a vertical line extending from the state (d) to the state (g) in FIG. 7.

The low-temperature/low-pressure refrigerant that comes out from the bypass expansion valve 6 in a gas-liquid two-phase state flows into the heat exchanger 7 where, while taking heat from the medium-temperature/low-pressure refrigerant that comes out from the condenser 2 (through heat exchange), the low-temperature/low-pressure refrigerant turns into a medium-temperature/low-pressure refrigerant in the state of vapor whose temperature is higher than the low-temperature/low-pressure refrigerant.

The change of the low-temperature/low-pressure refrigerant in the heat exchanger 7 takes place under a substantially constant level of pressure. Given the pressure losses from the heat exchanger 7, the change of the refrigerant is represented by a straight line extending from the state (g) to the state (a) in FIG. 7 which is nearly horizontal and slightly leans.

(Expansion Operation by Main Circuit)

Meanwhile, the rest of the liquid high-pressure refrigerant that comes out from the heat exchanger 7 is narrowed at the expansion valve 3 to expand (decompression) to be in a low-temperature/low-pressure gas-liquid two-phase state. The change of the refrigerant at the expansion valve 3 occurs under a constant level of enthalpy. The change of the refrigerant is represented by a vertical line extending from the state (d) to the state (e) in FIG. 7.

(Gas-Liquid Separation Operation)

The low-temperature/low-pressure refrigerant that comes out from the expansion valve 3 in a gas-liquid two-phase state flows into the gas-liquid separator 8 where the low-temperature/low-pressure refrigerant is separated into vapor and liquid. At this time, the vapor is represented by the state (h) on a saturation vapor line. The liquid is represented by the state (f) on a saturation liquid line.

The separated liquid low-temperature/low-pressure refrigerant flows into the evaporator 4 where the separated liquid low-temperature/low-pressure refrigerant turns into a gas, or a medium-temperature/low-pressure refrigerant in the state of vapor, as the refrigerant is deprived of cold heat by the air or the like (through heat exchange) and evaporates. The change of the refrigerant in the evaporator 4 occurs under a substantially constant level of pressure. Given the pressure losses from the evaporator 4, the change of the refrigerant is represented by a straight line extending from the state (f) to the state (a) in FIG. 7 which is nearly horizontal and slightly leans.

Meanwhile, the vapor separated by the gas-liquid separator 8 is narrowed at the gas flow control valve 9 to expand (decompression) and turns into a low-temperature/low-pressure refrigerant in the state of vapor. The change of the refrigerant at the gas flow control valve 9 occurs under a constant level of enthalpy. The change of the refrigerant takes place under a constant level of enthalpy as indicated by a line extending from the state (h) to the state (a) in FIG. 7.

The medium-temperature/low-pressure refrigerant that comes out from the evaporator 4 in the state of vapor mixes with the medium-temperature/low-pressure refrigerant that comes out from the bypass pipe 5 and with the low-temperature/low-pressure refrigerant that comes out from the gas pipe 10 and then flows into the compressor 1 where the refrigerant is compressed.

In the refrigeration cycle device having the above configuration, the amount of the refrigerant that flows into the evaporator in the state of vapor can be reduced; the pressure losses of the refrigerant in the evaporator can be reduced. Therefore, the efficiency of the refrigeration cycle device improves.

Fourth Embodiment (Refrigeration Cycle)

Figure 8:
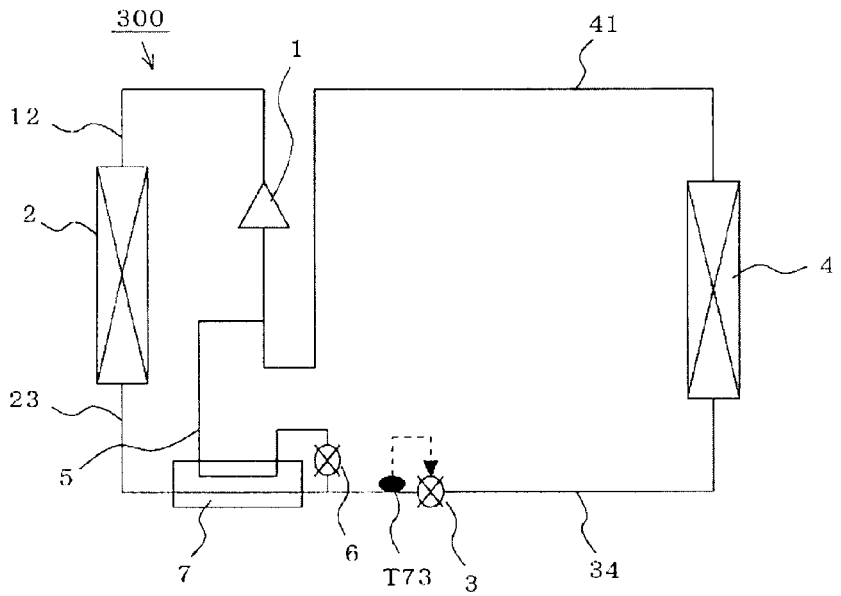
FIG. 8 is a refrigerant circuit diagram illustrating the configuration of a refrigeration cycle device according to a fourth embodiment of the present invention.

FIG. 8 is a refrigerant circuit diagram illustrating the configuration of a refrigeration cycle device according to a fourth embodiment of the present invention. In FIG. 8, a refrigeration cycle device 300 is formed by removing the following components the refrigeration cycle device 100 (First Embodiment) is equipped with: the evaporator inlet pressure sensor P34 and evaporator outlet pressure sensor P41 provided on the main circuit, the superheat degree sensor T71 provided on the bypass pipe 5, and the superheat degree control section 11*b*. The configuration of the other portions is the same as that of the refrigeration cycle device 100. Therefore, the same portions have been denoted by the same reference symbols and will not be described.

(Bypass Pipe)

That is, the bypass expansion valve 6 is provided on the bypass pipe 5 that bypasses the expansion valve 3 and the evaporator 4. Part of the bypass pipe 5 forms the heat exchanger 7 at the downstream side of the bypass expansion valve 6.

(Control Procedure)

The following describes the operation of the expansion valve 3 and the bypass expansion valve 6.

The controlling by the expansion valve 3 is such that the subcooling degree of the medium-temperature/high-pressure refrigerant detected by the subcooling degree sensor T73 installed at the downstream side of the heat exchanger 7 on the path (a portion of the medium-temperature/high-pressure pipe 23) extending from the heat exchanger 7 to the expansion valve 3 is greater than or equal to a predetermined value. That is, when the subcooling degree is less than the predetermined value, the opening of the expansion valve 3 is narrowed. On the other hand, when the subcooling degree is greater than the predetermined value, the opening is widened.

At this time, instead of the expansion valve 3, the bypass expansion valve 6 may be controlled. For example, when the subcooling degree is smaller than a predetermined value, the opening of the bypass expansion valve 6 is widened. On the other hand, when the subcooling degree is greater than the predetermined value, the opening is closed.

Furthermore, both the expansion valve 3 and the bypass expansion valve 6 may be controlled. For example, when the subcooling degree is smaller than a predetermined value, the opening of the expansion valve 3 is narrowed while the opening of the bypass expansion valve 6 is opened. On the other hand, when the subcooling degree is greater than the predetermined value, the former is opened while the latter is closed.

(Running Operation)

The running operation of the refrigeration cycle device 300 is the same as that of the refrigeration cycle device 100 and therefore will not be described (Refer to FIGS. 3 and 4).

Therefore, when the low-GWP refrigerant used in the refrigeration cycle device 300 has the characteristics of combustibility or low combustibility as described above, the permissible amount of refrigerant is suppressed and the amount of heat exchanged by the condenser 2 (the length of the pipe and the like) is small. Therefore, the medium-temperature/high-pressure refrigerant at the outlet of the condenser 2 is expected to be in a gas-liquid two-phase state. However, even when the refrigeration cycle device 300 having the above configuration is operated in such a way that the medium-temperature/high-pressure refrigerant at the outlet of the condenser 2 can be in a gas-liquid two-phase state, the refrigeration cycle device 300 can be controlled to have the medium-temperature/high-pressure refrigerant subcooled at the expansion valve 3 and at the inlet of the bypass expansion valve 6. Therefore, the refrigeration cycle device 300 can carry out the stable flow control (expansion) of the refrigerant.

Incidentally, the controlling by the refrigeration cycle device 300 is not to set the target value of the superheat degree on the basis of the evaporator pressure difference (LP). However, the target value of the superheat degree may be set in accordance with the frequency of the compressor 1, the inlet pressure of the compressor 1, and the like instead of the evaporator pressure difference ($\Delta P$).

Other Embodiments

The present invention is not limited to the above-described first to fourth embodiments and includes the following variations.

(1) In the first to fourth embodiments, described is the case in which the combustible refrigerant circulates. However, the present invention is limited to this. Other low-GWP refrigerants may be used that come with a limit on the amount of the filled refrigerant in accordance with the level of toxicity or greenhouse effect instead of a limit arising from combustibility. At this time, a similar effect to those of the above-described first to fourth embodiments is obtained.

(2) In the first to fourth embodiments, described is the case in which the downstream side of the bypass pipe 5 or gas pipe 10 is connected to the upstream side of the compressor 1 (which is the same as the medium-temperature/low-pressure pipe 41). However, the present invention is not limited to this. The downstream side of the bypass pipe 5 or gas pipe 10 may be connected midway of the compression process of the compressor 1 to mix the refrigerant that has flowed out of the bypass pipe 5 or gas pipe 10 before returning the refrigerant into the compressor 1, i.e., the refrigerant that has been compressed to a certain degree after passing through the medium-temperature/low-pressure pipe 41 is mixed with the refrigerant that has flowed out of the bypass pipe 5 or gas pipe 10. Even in this case, a similar effect is obtained.

(3) In the first to fourth embodiments, the expansion valve 3 is so controlled that the subcooling degree of the medium-temperature/high-pressure refrigerant detected by the subcooling degree sensor T73 is greater than or equal to a predetermined value, and the expansion valve 3 is controlled in accordance with the detected value. However, the upper and lower limits on the opening may be provided. According to such configuration, not only is the above effect obtained, but it is possible to prevent the excess refrigerant from flowing into the bypass pipe 5 and the malfunction of the refrigeration cycle resulting from excessive narrowing. In addition, it is possible to prevent the liquid from returning to the compressor 1.

(4) In accordance with a change in the amount of the filled refrigerant or the length of the extension pipe, the control target values of the subcooling degree or pressure difference may be changed. For example, if the amount of the filled refrigerant decreases or if the extension pipe becomes longer in length, the control target value of the subcooling degree is set at a small value. On the other hand, if the amount of the filled refrigerant increases or if the extension pipe becomes shorter in length, the control target value of the subcooling degree is set at a large value.

(5) if the filled refrigerant is one whose gas density is different at the low pressure side, the control target value of the pressure difference may be changed. A refrigeration cycle device having such configuration can obtain a similar effect to those of the first to third embodiments even when a different low-GWP refrigerant is used or when the extension pipe is different in length.

(6) In the first to third embodiments, the configuration allows the compressor 1 to directly inhale the medium-temperature/low-pressure refrigerant flowing out of the evaporator 4. However, an accumulator may be provided at the upstream side of the compressor 1 (the medium-temperature/low-pressure pipe 41) to prevent the liquid from returning to the compressor 1.

(7) In the first to third embodiments, "refrigerant circuit components" including the following components are not provided: a strainer that captures debris in the refrigerant, a drier that captures moisture in the refrigerant, an oil separator that extracts the refrigeration machine oil discharged from the compressor 1 to return the oil to the compressor 1, and a stop valve (on-off valve) for connection works for circulation pipes and the like. However, the refrigerant circuit components may be installed, so that an auxiliary machine is provided to ensure the reliability of the refrigeration cycle devices 100, 200, and 300.

(8) In the first to second embodiments, the direction of the flow of the refrigerant in the heat exchanger 7 is not explicitly explained. However, a configuration can be applied that switches the direction of the flow in accordance with type of the refrigerant.

Figure 9:
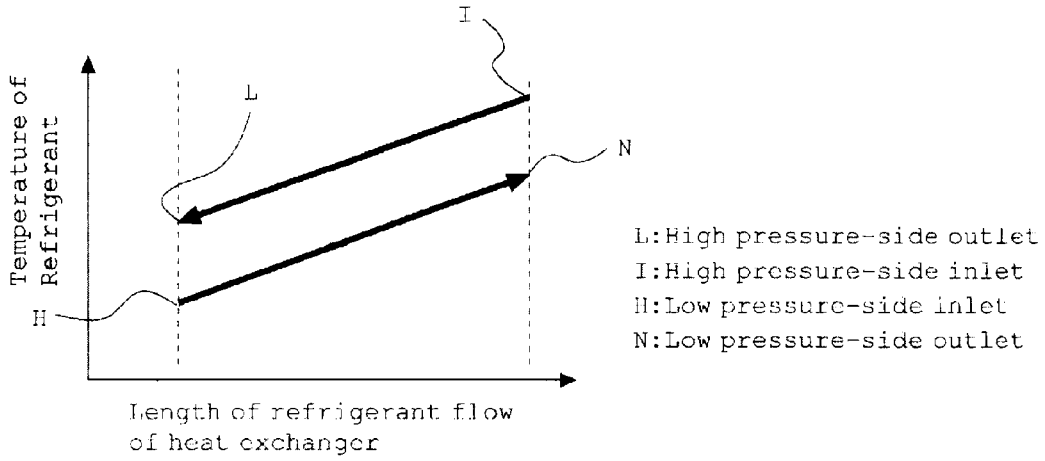
FIG. 9 is a schematic diagram illustrating a correlation between the length of the flow direction of a heat exchanger of the refrigerant cycle device of the first embodiment of the present invention and the temperature of a refrigerant.
Figure 10:
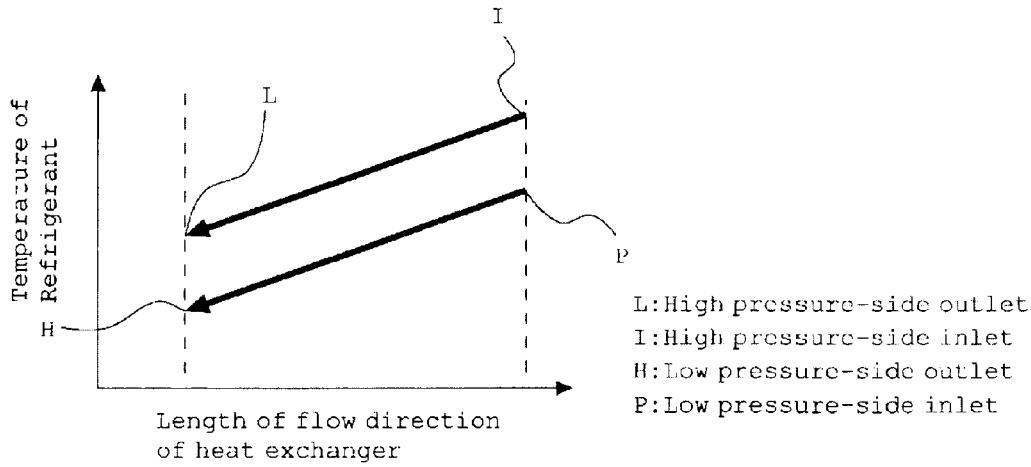
FIG. 10 is a schematic diagram illustrating a correlation between the length of the flow direction of the heat exchanger of the refrigerant cycle device of the first embodiment of the present invention and the temperature of a refrigerant.

FIGS. 9 and 10 are schematic diagrams for explaining a correlation between the length of the flow direction of the heat exchanger 7 of the refrigeration cycle device according to the first embodiment of the present invention and the temperature of the refrigerant. FIG. 9 shows the case of an opposed flow. FIG. 10 shows the case of a parallel flow.

FIG. 9 illustrates how an opposed flow-type heat exchanger operates for a refrigerant whose temperature increases as the refrigerant evaporates. The horizontal axis represents the length of the pipe that constitutes the heat exchanger 7 (which is the same as the length of the flow direction of the refrigerant); the vertical axis schematically represents the temperature of the refrigerant. That is, the high temperature-side refrigerant flows in through an inlet I, is cooled after being deprived of heat, and then flows out of an outlet L.

On the other hand, the low temperature-side refrigerant flows in through an inlet H, takes in heat to evaporate with an increase in temperature, and then flows out from an outlet N. Accordingly, there is heat exchange between the low temperature-side refrigerant that is in the later stage of temperature rising and the high temperature-side refrigerant that is in the initial stage of temperature dropping, and there is heat exchange between the low temperature-side refrigerant that is in the initial stage of temperature rising and the high temperature-side refrigerant that is in the later stage of temperature dropping.

Therefore, in the entire area of the pipe constituting the heat exchanger 7 (which is the same as the entire process of heat exchange), the difference in temperature between the high temperature (high pressure)-side refrigerant and the low temperature (low pressure)-side refrigerant can be reduced (or kept at a substantially constant level), thereby making it possible to efficiently carry out heat exchange. Incidentally, FIG. 9 shows two parallel straight lines. However, the lines may not be parallel to each other or may be in the shape of an arc. Incidentally, the same holds true for the refrigeration cycle devices 200 and 300 and therefore will not be described.

FIG. 10 illustrates how the heat exchanger 7 operates when a capillary tube is placed at the downstream side of the bypass expansion valve 6 of the bypass pipe 5 of the refrigeration cycle device according to the first embodiment of the present invention to expand the refrigerant and when the heat exchanger 7 is formed by the capillary tube and part of the medium-temperature/high-pressure pipe 23. That is, in the bypass pipe 5, the low-temperature/low-pressure refrigerant that has flowed out of the bypass expansion valve 6 flows into the capillary tube (which is the same as the heat exchanger 7) through an inlet P, gradually decreases in temperature and pressure, and then flows out of an outlet.

On the other hand, in the medium-temperature/high-pressure pipe 23, the medium-temperature/high-pressure refrigerant flows in through the inlet I and flows out from the outlet L. Meanwhile, the medium-temperature/high-pressure refrigerant takes in cold heat from the low-temperature/low-pressure refrigerant and therefore gradually decreases in temperature.

Thus, in the entire area of the pipe constituting the heat exchanger 7 (which is the same as the entire process of heat exchange), the difference in temperature between the high temperature (high pressure)-side refrigerant and the low temperature (low pressure)-side refrigerant can be reduced (or kept at a substantially constant level), thereby making it possible to efficiently carry out heat exchange. Incidentally, FIG. 9 shows two parallel straight lines. However, the lines may not be parallel to each other or may be in the shape of an arc. Incidentally, the same holds true for the refrigeration cycle devices 200 and 300 and therefore will not be described.

Figure 11:
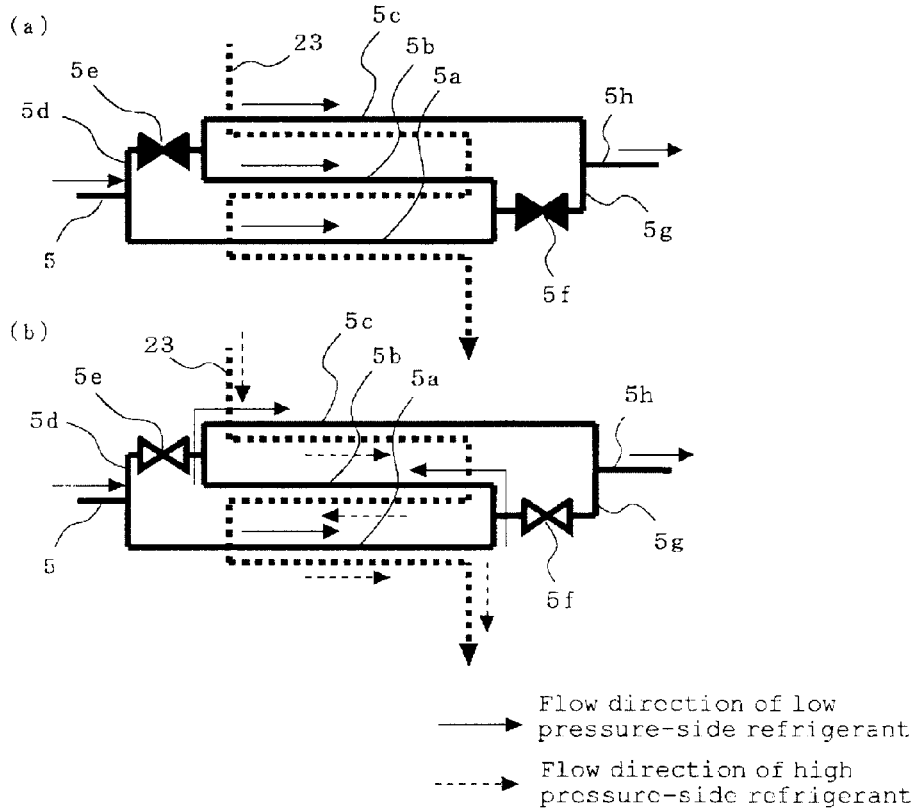
FIG. 11 is a schematic diagram illustrating a flow path of a refrigerant in the heat exchanger of the refrigeration cycle device of the first embodiment of the present invention.

(9) In the first to third embodiments, the divergence of the refrigerant in the heat exchanger 7 is not described. However, part of the bypass pipe 5 through which the low-temperature/low-pressure refrigerant passes may diverge from the bypass pipe 5 to form a plurality of heat conduction tubes; a heat exchanger may be used that includes a number-of-diverging-points variable section that changes the heat conduction tubes (which is the same as the number of heat conduction tubes) through which the refrigerant actually flows. FIG. 11 shows refrigerant circuit diagrams illustrating an example of the flow path of the refrigerant in the heat exchanger of the refrigeration cycle device according to the first embodiment of the present invention.

In FIG. 11(*a*), the medium-temperature/high-pressure pipe 23 flows along the dashed-line path in the direction indicated by arrows as the medium-temperature/high-pressure pipe 23 meanders (In the diagram, the medium-temperature/high-pressure pipe 23 flows from the upper side to the lower side in general with horizontal flows emerging on the way).

On the other hand, the downstream side of the bypass expansion valve 6 of the bypass pipe 5 through which the low-temperature/low-pressure refrigerant flows diverges. That is, the heat conduction tube 5*a* and the heat conduction tube 5*d* diverge from the bypass pipe 5 at the inlet of the heat exchanger 7. An on-off valve 5*e* is provided on the heat conduction tube 5*d*. The heat conduction tubes 5*b* and 5*c* diverge at the downstream side of the on-off valve 5*e*. At the outlet of the heat exchanger 7, the heat conduction tubes 5*a* and 5*b* combine with the heat conduction tube 5*g* at which an on-off valve 5*f* is provided. At the downstream side of the on-off valve 5*f*, the heat conduction tube 5*g* combines with the heat conduction tube 5*h*. The heat conduction tube 5*h* forms the downstream portion that follows the heat exchanger 7 of the bypass pipe 5.

Therefore, if the pressure loss of the low-temperature/low-pressure refrigerant is large, the on-off valves 5*e* and 5*f* open, separating the low-temperature/low-pressure refrigerant into three paths, the heat conduction tubes 5*a*, 5*b*, and 5*c*. Therefore, the streams of the low-temperature/low-pressure refrigerant flow in parallel through the three paths (FIG. 11(*a*)).

Meanwhile, if the pressure loss of the low-temperature/low-pressure refrigerant is small, the on-off valves 5*e* and 5*f* close; the low-temperature/low-pressure refrigerant flows through one path, the heat conduction tubes 5*a*, 5*b*, and 5*c* in that order (FIG. 11(*b*)).

The refrigeration cycle device having such configuration can prevent the increase in pressure loss of the low-temperature/low-pressure refrigerant in the heat exchanger 7. When the flow and the pressure loss become smaller, a reduction in the number of diverging points can increase the speed of the flow, thereby leading to an increase in heat exchange efficiency.

Incidentally, the above has described the case in which the path is separated into three paths. However, the present invention is not limited to this. Moreover, the direction of the refrigerant flowing through the heat conduction tubes 5*a*, 5*b*, and 5*c* and the direction of the refrigerant flowing through the medium-temperature/high-pressure pipe 23 are not limited to those illustrated in the diagrams: The refrigerants may flow in opposing directions or in parallel directions according to circumstances. Incidentally, the same holds true for the refrigeration cycle devices 200 and 300 and therefore will not be described.

(10) The following describes the correlation between heat conduction and pressure loss of the evaporator 4 according to the first to fourth embodiments.

Figure 12:
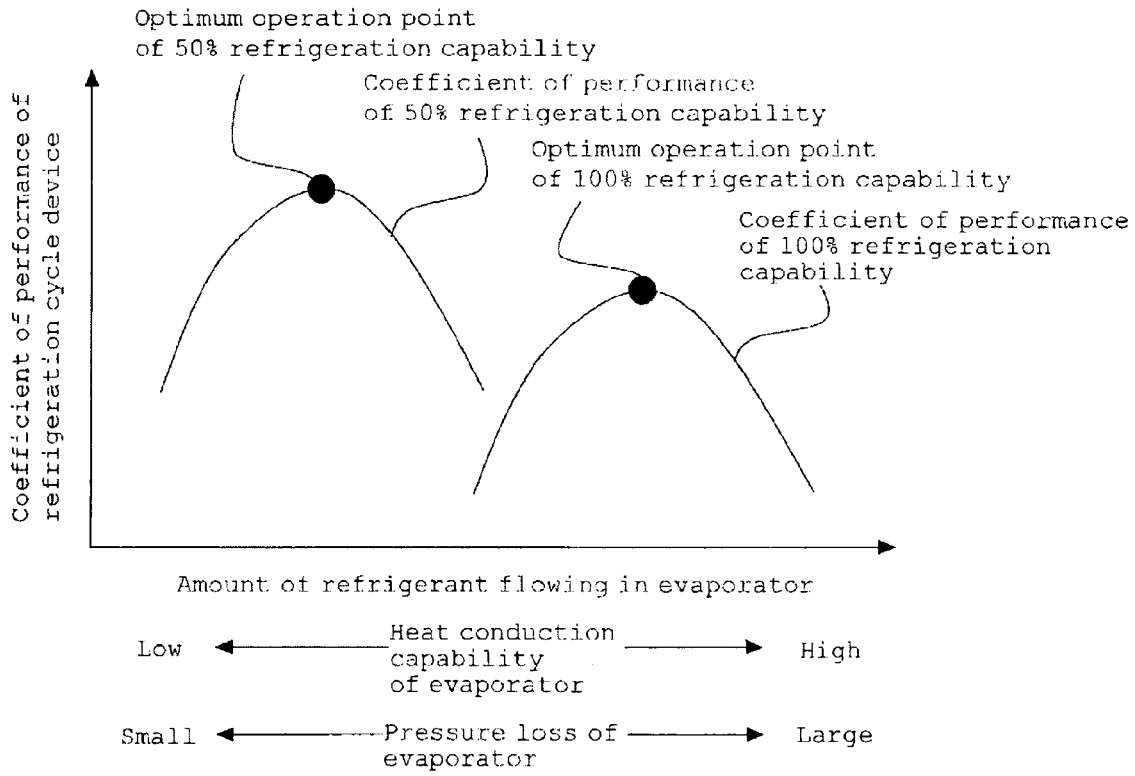
FIG. 12 is a graph showing a correlation between the amount of refrigerant flowing in an evaporator of the refrigeration cycle device of the first embodiment of the present invention and the coefficient of performance of the refrigeration cycle device.

FIG. 12 is a graph showing the correlation between the amount of the refrigerant flowing in the evaporator of the refrigeration cycle device according to the first embodiment of the present invention and the coefficient of performance of the refrigeration cycle device. Incidentally, the coefficient of performance represents a ratio of refrigeration capability to the electricity input into the refrigeration cycle device 100.

The heat conduction capability of the evaporator 4 and the pressure loss of the evaporator 4 are in proportion to the amount of refrigerant flowing into the evaporator 4. As the amount of the flowing refrigerant increases, the heat conduction capability increases while the pressure loss increases. In FIG. 12, the two solid lines represent the correlation between the coefficient of performance and the amount of the flowing refrigerant when the refrigeration capability of the refrigeration cycle device 100 is 100 percent and the correlation between the coefficient of performance and the amount of the flowing refrigerant when the refrigeration capability of the refrigeration cycle device 100 is 50 percent, respectively. As the amount of the flowing refrigerant increases, the heat conduction capability of the evaporator increases, leading to an increase in capability. However, the pressure loss also increases. As a result, there are optimum operation points (pressure loss) corresponding to each level of refrigeration capability (In the diagram, the filled circles represent optimum operation points). Incidentally, the same holds true for the refrigeration cycle devices 200 and 300 and therefore will not be described.

Incidentally, according to the above-described embodiments, as the subcooling degree sensor, the pressure sensor and the temperature sensor are used in combination. However, anything can be used for the subcooling degree sensor as long as the sensor can directly detect or indirectly estimate the subcooling degree. For example, when the use environment is relatively stable, the sensor may measure either one of the pressure or temperature, and an estimated value in the use environment may be used for the other. Moreover, the subcooling degree may be calculated by using the rotation frequency of the compressor, the detected values of the outlet pressure and temperature, and the condensation temperature. The superheat degree may be calculated by using the inlet pressure of the compressor, the outlet pressure of the evaporator, the detection value of the evaporation temperature, or the like.

Moreover, the subcooling degree is not necessarily calculated, as long as the subcooling degree control process is so performed that the subcooling degree, as a result, is controlled within an appropriate range on the basis of the refrigerant state such as the detection values of the temperature sensor and the pressure sensor or on the basis of the operation state of the refrigeration cycle. As for the superheat degree control process, the figure is not necessarily calculated, as long as the superheat degree is similarly under control.

Any component other than the bypass pipe may be used as the heat exchanger that carries out subcooling, as long as the component can subcool the refrigerant. For example, an additional device, such as economizer, may be used that employs another method of refrigeration cycle by which heat is exchanged with another cold-heat portion in the refrigeration cycle.

INDUSTRIAL APPLICABILITY

The refrigeration cycle device of the present invention can operate in a stable manner even when there is a limit on the amount of the filled refrigerant and therefore be widely applied as every type of refrigeration cycle device while using a variety of low-GMP refrigerants.

The invention claimed is:

1. A refrigeration cycle device comprising: a compressor that compresses a combustible refrigerant;

a condenser that condenses the combustible refrigerant compressed by the compressor;

a heat exchanger that subcools the combustible refrigerant discharged from the condenser; an expansion valve that expands the combustible refrigerant subcooled by the heat exchanger;

an evaporator that evaporates the combustible refrigerant expanded by the expansion valve;

an evaporator upstream pressure sensor that detects a pressure of the combustible refrigerant in a pipe between an upstream side of the evaporator and a downstream side of the expansion valve;

an evaporator downstream pressure sensor that detects a pressure of the combustible refrigerant in a pipe between a downstream side of the evaporator and an upstream side of the compressor;

a bypass pipe that connects an upstream pipe of the compressor and a downstream pipe of the heat exchanger;

a bypass expansion valve provided on the bypass pipe to expand a secondary stream that diverges from a primary stream of the combustible refrigerant flowing through the downstream pipe; and a controller configured to:

acquire a detected pressure value from the evaporator upstream pressure sensor and a detected pressure value from the evaporator downstream pressure sensor;

calculate an evaporator pressure difference wherein the evaporator pressure difference is the difference between the detected pressure value from the evaporator upstream pressure sensor and the detected pressure value from the evaporator downstream pressure sensor;

increase the opening of the bypass expansion valve when the evaporator pressure difference is greater than a control target value; and decrease the opening of the bypass expansion valve when the evaporator pressure difference is less than a control target value.

2. The refrigeration cycle device of claim 1, comprising a combustible refrigerant whose quantity is less than or equal to the permissible quantity of refrigerant of an air-conditioned space determined by a lean flammability limit of the combustible refrigerant.

3. The refrigeration cycle device of claim 1, comprising a combustible refrigerant whose quantity is less than or equal to the permissible quantity of refrigerant of a cooled space of the refrigeration cycle device specified by a lean flammability limit of the combustible refrigerant.

4. The refrigeration cycle device of claim 1, further comprising:

a subcooling degree detection section that detects the subcooling degree of the primary stream of the combustible refrigerant at the inlet side of the expansion valve, wherein the heat exchanger is thermally connected to the downstream side of the bypass expansion valve of the bypass pipe, and the controller controls the opening of at least either the expansion valve or the bypass expansion valve on the basis of the detection result by the subcooling degree detection section so that the subcooling degree of the primary stream is greater than or equal to a predetermined value.

5. The refrigeration cycle device of claim 1, wherein the heat exchanger is thermally connected to the downstream side of the bypass expansion valve of the bypass pipe, and the controller controls the subcooling degree of the primary stream and the superheat degree of the secondary stream.

6. The refrigeration cycle device of claim 5, wherein the controller controls the opening of the expansion valve on the basis of the temperature of the primary stream and the opening of the bypass expansion valve on the basis of the temperature of the secondary stream.

7. The refrigeration cycle device of claim 5, wherein the controller controls the opening of the expansion valve on the basis of the subcooling degree of the primary stream and the opening of the bypass expansion valve on the basis of the superheating degree of the secondary stream.

8. The refrigeration cycle device of claim 5, wherein the controller increases the amount of the combustible refrigerant flowing through the bypass pipe and raises the subcooling degree of the combustible refrigerant between an outlet of the heat exchanger and the expansion valve.

9. The refrigeration cycle device of claim 4, further comprising:

a superheat degree detection section that detects the superheat degree of the combustible refrigerant at the downstream side of the heat exchanger in the bypass pipe, wherein the controller includes a superheat degree control section that sets a control target value of the superheat degree of the combustible refrigerant in the bypass pipe, and the controller controls the bypass expansion valve so that the superheat degree detected by the superheat degree detection section becomes the control target value set by the superheat degree control section.

10. The refrigeration cycle device of claim 1, further comprising a subcooling degree control section that changes a control target value of the subcooling degree of the combustible refrigerant at an inlet of the expansion valve in accordance with either the type of the combustible refrigerant or the length of an extension pipe, or both.

11. The refrigeration cycle device of claim 4, wherein when either the difference in pressure between the combustible refrigerant at an inlet of the bypass pipe and the combustible refrigerant at an outlet of the bypass pipe or the difference in pressure between the combustible refrigerant at an inlet of the evaporator and the combustible refrigerant at an outlet of the evaporator, or both, increases, the controller controls the opening of the bypass expansion valve such that the quantity of the combustible refrigerant flowing through the bypass pipe is increased.

12. The refrigeration cycle device of claim 4, wherein the secondary and primary streams flow directions in the heat exchanger are opposed.

13. The refrigeration cycle device of claim 4, wherein:

a capillary tube that expands the combustible refrigerant is disposed at the downstream of the bypass expansion valve of the bypass pipe, and the heat exchanger is formed by the capillary tube and part of a connection pipe that connects the condenser and the expansion valve; and the direction in which the combustible refrigerant in the capillary tube flows is parallel to the direction in which the combustible refrigerant in the connection pipe flows.

14. The refrigeration cycle device of claim 4, wherein:

part of the bypass pipe is separated into a plurality of heat conduction tubes at an inlet of the heat exchanger;

a plurality of the heat conduction tubes are put together at an outlet of the heat exchanger; and a number-of-diverging-points variable section that changes the heat conduction tubes through which the combustible refrigerant flows out of a plurality of the heat conduction tubes is included.

15. The refrigeration cycle device of claim 4, further comprising a gas-liquid separator provided between the expansion valve and the evaporator; a gas pipe that allows the combustible refrigerant in the state of vapor separated by the gas-liquid separator to flow into the compressor; and a gas flow control valve provided on the gas pipe to control the flow quantity of the combustible refrigerant.

16. The refrigeration cycle device of claim 15, further comprising:

a gas flow control valve upstream pressure sensor that detects the pressure of the combustible refrigerant at the upstream side of the gas flow control valve of the gas pipe; and a gas flow control valve downstream pressure sensor that detects the pressure of the combustible refrigerant at the downstream side of the gas flow control valve of the gas pipe, wherein the gas flow control valve is controlled in accordance with a pressure value detected by the gas flow control valve upstream pressure sensor and a pressure value detected by the gas flow control valve downstream pressure sensor.

17. A refrigeration cycle device comprising: a compressor that compresses a combustible refrigerant; a condenser that condenses the combustible refrigerant compressed by the compressor; a heat exchanger that subcools the combustible refrigerant discharged from the condenser; an expansion valve that expands the combustible refrigerant subcooled by the heat exchanger; an evaporator that evaporates the combustible refrigerant expanded by the expansion valve; a bypass pipe that connects an upstream pipe of the compressor to an downstream pipe of the heat exchanger; a bypass expansion valve provided on the bypass pipe to expand a secondary stream that diverges from a primary stream of the combustible refrigerant flowing through the downstream pipe; a controller that controls an amount of heat exchange of the heat exchanger in accordance with a temperature or pressure of the combustible refrigerant between the condenser and the expansion valve; an evaporator upstream pressure sensor that detects a pressure of a refrigerant in a pipe between an upstream side of the evaporator and a downstream side of the expansion valve; an evaporator downstream pressure sensor that detects a pressure of a refrigerant in a pipe between a downstream side of the evaporator and an upstream side of the compressor; and a superheat degree detection section that detects a superheat degree of the combustible refrigerant at a downstream side of the heat exchanger in the bypass pipe, wherein the controller includes a superheat degree control section and is configured to:

acquire a detected pressure value from the evaporator upstream pressure sensor and a detected pressure value from the evaporator downstream pressure sensor;

calculate an evaporator pressure difference wherein the evaporator pressure difference is the difference between the detected pressure value from the evaporator upstream pressure sensor and the detected pressure value from the evaporator downstream pressure sensor;

set a superheat control target value based on the calculated evaporator pressure difference; and control the opening of the bypass expansion valve such that the superheat degree detected by the superheat degree detection section becomes the superheat control target value.

18. The refrigeration cycle device of claim 17, further comprising:

a subcooling degree detection section that detects the subcooling degree of the primary stream of the combustible refrigerant at the inlet side of the expansion valve, wherein the heat exchanger is thermally connected to the downstream side of the bypass expansion valve of the bypass pipe, and wherein the controller controls the opening of at least either the expansion valve or the bypass expansion valve on the basis of the detection result by the subcooling degree detection section so that the subcooling degree of the primary stream is greater than or equal to a predetermined value.

19. The refrigeration cycle device of claim 17, wherein the heat exchanger is thermally connected to the downstream side of the bypass expansion valve of the bypass pipe, and wherein the controller controls the subcooling degree of the primary stream and the superheat degree of the secondary stream.

20. The refrigeration cycle device of claim 1, wherein the controller increases the opening of the bypass expansion valve when the evaporator pressure difference is at least 0.01 Mpa greater than the control target value.

21. The refrigeration cycle device of claim 17, wherein the superheat degree control selection decreases the superheat control target value when the calculated evaporator pressure difference is at least 0.01 Mpa greater than a pressure control target value.

* * * * *